US009416589B2

(12) United States Patent
McTavish et al.

(10) Patent No.: US 9,416,589 B2
(45) Date of Patent: Aug. 16, 2016

(54) DEFORMABLE GUIDE FOR A ROLLABLE DOOR, ROLLABLE DOOR GUIDING SYSTEM HAVING A DEFORMABLE GUIDE, AND DOOR USING THE SAME

(71) Applicant: INDOTECH INDUSTRIAL DOORS INC., Boucherville, Québec (CA)

(72) Inventors: Don McTavish, Boucherville (CA); Juan Palencia, Montréal (CA); Daniel Deland, Longueuil (CA)

(73) Assignee: Indotech Industrial Doors Inc., Boucherville, Quebec (CA)

( * ) Notice: Subject to any disclaimer, the term of this patent is extended or adjusted under 35 U.S.C. 154(b) by 0 days.

(21) Appl. No.: 14/082,334

(22) Filed: Nov. 18, 2013

(65) Prior Publication Data

US 2014/0158313 A1 Jun. 12, 2014

Related U.S. Application Data

(60) Provisional application No. 61/735,739, filed on Dec. 11, 2012.

(51) Int. Cl.
*E06B 9/58* (2006.01)

(52) U.S. Cl.
CPC . *E06B 9/581* (2013.01); *E06B 9/58* (2013.01); *E06B 2009/585* (2013.01)

(58) Field of Classification Search
USPC ..... 160/273.1
IPC ..... E06B 9/581,9/58, 2009/585
See application file for complete search history.

(56) References Cited

U.S. PATENT DOCUMENTS

| | | | | | |
|---|---|---|---|---|---|
| 2,349,226 | A | * | 5/1944 | Thomas | 160/273.1 |
| 4,478,268 | A | * | 10/1984 | Palmer | 160/310 |
| 4,601,320 | A | * | 7/1986 | Taylor | 160/271 |
| 5,058,651 | A | * | 10/1991 | Ashley et al. | 160/271 |
| 5,392,836 | A | * | 2/1995 | West et al. | 160/273.1 |
| 5,482,104 | A | * | 1/1996 | Lichy | 160/273.1 |
| 5,964,270 | A | * | 10/1999 | Kirkey et al. | 160/273.1 |
| 5,964,271 | A | * | 10/1999 | Lapointe | 160/273.1 |
| 6,119,758 | A | | 9/2000 | Coenraets | |
| 6,715,531 | B2 | * | 4/2004 | Simon | 160/271 |

(Continued)

FOREIGN PATENT DOCUMENTS

| | | |
|---|---|---|
| CA | 2 471 198 A1 | 7/2003 |
| CA | 2 446 648 A1 | 1/2004 |

(Continued)

*Primary Examiner* — David Purol
(74) *Attorney, Agent, or Firm* — Muirhead and Saturnelli, LLC

(57) ABSTRACT

A deformable guide for a rollable door is disclosed. The guide has two wall portions. One wall portion defines a longitudinal edge while another wall portion defines an inner longitudinal planar face. Together, the inner longitudinal planar face and the longitudinal edge define a longitudinal slot. The guide receives, via the longitudinal slot, a longitudinal end section of a rollable door side strip, the inner longitudinal planar face of the guide providing a mating surface for a planar surface of the side strip. A longitudinal rib of the longitudinal end section of the side strip is maintained within the guide. The side strip is released by widening of the longitudinal slot upon application on the side strip of a force exceeding a predetermined threshold. A guiding system including the deformable guide and the side strip and a rollable door including the guiding system are also disclosed.

7 Claims, 9 Drawing Sheets

(56) References Cited

U.S. PATENT DOCUMENTS

| | | | | |
|---|---|---|---|---|
| 6,942,003 | B2 | 9/2005 | Thompson | |
| 7,028,741 | B2 * | 4/2006 | Coenraets | 160/273.1 |
| 7,275,581 | B2 * | 10/2007 | Coenraets | 160/273.1 |
| 7,516,770 | B2 | 4/2009 | Jerry | |
| 7,748,431 | B2 * | 7/2010 | Jansen et al. | 160/268.1 |
| 8,291,960 | B2 | 10/2012 | Bowman | |
| 2005/0005545 | A1 * | 1/2005 | Jerry | 52/204.5 |
| 2005/0016695 | A1 | 1/2005 | Thompson | |
| 2012/0241105 | A1 | 9/2012 | Drifka et al. | |

FOREIGN PATENT DOCUMENTS

| | | | |
|---|---|---|---|
| CA | 2 426 217 | A1 | 10/2004 |
| CA | 2 463 208 | A1 | 1/2005 |
| EP | 1 223 300 | A1 | 7/2002 |
| WO | WO 99/02812 | | 1/1999 |

* cited by examiner

DEFORMABLE GUIDE FOR A ROLLABLE DOOR, ROLLABLE DOOR GUIDING SYSTEM HAVING A DEFORMABLE GUIDE, AND DOOR USING THE SAME

TECHNICAL FIELD

The present disclosure relates to the field of door systems. More specifically, the present disclosure relates to a deformable guide for a rollable door, to a guiding system for a rollable door, the guiding system having a deformable guide, and to a door using the deformable guide.

BACKGROUND

Roll-up doors offer wide flexibility in terms of sizes and the capability of undergoing large numbers of fast opening and closing cycles in a single day. They are used, predominantly in commercial and industrial applications. These doors usually comprise a large curtain made of a flexible material, for example rubber, supported by guides on each side of a door frame.

Because roll-up doors may be very large, they may withstand excessive wind loads leading to ripping or tearing of the curtain, or to breakage of the guides or door frame. Also, as trucks and like vehicles enter and leave commercial or industrial buildings through those doors, accidents are bound to happen and curtains may be hit, resulting in the tearing of a curtain or damage to door guides or frames.

Therefore, there is a need for a door system capable of limiting damages to buildings and to the door system itself under excessive load situations.

SUMMARY

According to the present disclosure, there is provided a deformable guide for a rollable door. The guide comprises two wall portions. A first one of the wall portions defines a longitudinal edge while a second one of the wall portions defines an inner longitudinal planar face. Together, the inner longitudinal planar face and the longitudinal edge define a longitudinal slot. The guide is configured to receive, via the longitudinal slot, a longitudinal end section of a rollable door side strip, the inner longitudinal planar face of the guide providing a mating surface for a planar surface of the side strip. The guide is also configured to maintain, within the guide, a longitudinal rib of the longitudinal end section of the side strip and to release the side strip by widening of the longitudinal slot upon application on the side strip of a force exceeding a predetermined threshold.

According to the present disclosure, there is also provided a guiding system for a rollable door. The guiding system comprises a deformable guide and a side strip. The deformable guide has two wall portions. A first one of the wall portions defines a longitudinal edge while a second one of the wall portions define an inner longitudinal planar face. Together, the inner longitudinal planar face and the longitudinal edge define a longitudinal slot. The side strip is configured for attachment to a curtain of the rollable door. The side strip has a longitudinal end section insertable into the guide via the longitudinal slot. The side strip also has a planar surface for mating with the inner longitudinal planar face. The longitudinal end section also comprises at least one longitudinal rib for maintaining the side strip within the guide. The guide is configured to release the side strip by widening of the longitudinal slot upon application on the side strip of a force exceeding a predetermined threshold.

The present disclosure further relates to a door. The door comprises a flexible door curtain and a guiding system. The guiding system is configured for attachment to a door frame and comprises a deformable guide and a side strip. The deformable guide has two wall portions. A first one of the wall portions defines a longitudinal edge while a second one of the wall portions defines an inner longitudinal planar face. Together, the inner longitudinal planar face and the longitudinal edge define a longitudinal slot. The side strip is configured for attachment to the door curtain. The side strip has a longitudinal end section insertable into the guide via the longitudinal slot, and a planar surface for mating with the inner longitudinal planar face. The longitudinal end section also comprises a longitudinal rib for maintaining the side strip within the guide. The guide is configured to release the side strip by widening of the longitudinal slot upon application on the door curtain of a force exceeding a predetermined threshold.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which.

DETAILED DESCRIPTION

Like numerals represent like features on the various drawings.

Various aspects of the present disclosure generally address one or more of the problems of damages to buildings and to rollable door systems under excessive wind load on rollable door curtains or resulting from accidental collisions of vehicles on such curtains.

Though rollable doors may be made to operate in various planes, the following description will refer mainly to roll-up doors, which are doors that open by moving their curtains upwards. The present disclosure applies to other rollable doors and reference to "roll-up doors" is made for illustration purposes only.

Figure 1:
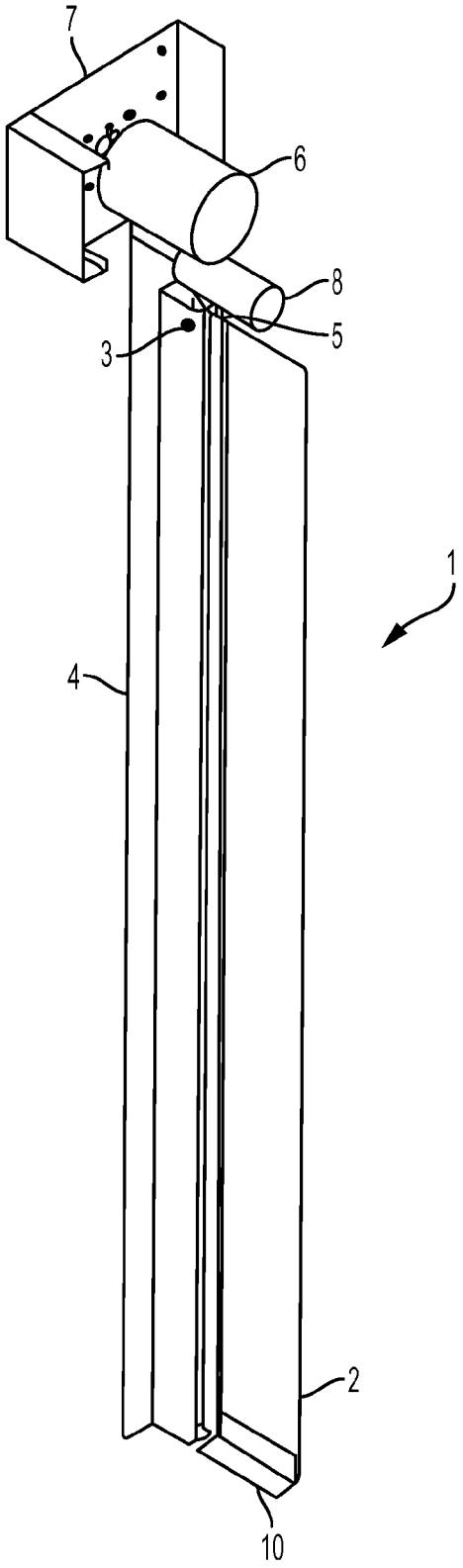
FIG. 1 is a perspective, partial view of a roll-up door system.

Referring now to the drawings, FIG. 1 is perspective, partial view of a roll-up door system. A roll-up door system, generally shown at 1, comprises a flexible curtain 2, a deformable vertical guide 3 that is mountable on a doorway frame 4, a vertical side strip 5 for connecting the curtain 2 to the vertical guide 3, and a main roller 6 for rolling the curtain 2. The roll-up door system 1 may also comprise a plate such as 7 for holding the roller 6 at both ends, an idler roller 8, and an iron angle 10 connected to the curtain 2 at its bottom, as are well-known in the art. Of course, realizations of the roll-up door system 1 may comprise two opposed vertical guides 3 and two opposed vertical side strips 5 on either sides of the curtain 2, with the main roller 6 extending between two plates 7 positioned atop of each vertical guides 3. Likewise, the idler roller 8, the iron angle 10 may extend along a width of the doorway. Later Figures will illustrate interaction of the vertical side strip 5 with the vertical guide 3 to form a guiding system for the roll-up door.

Figure 2:
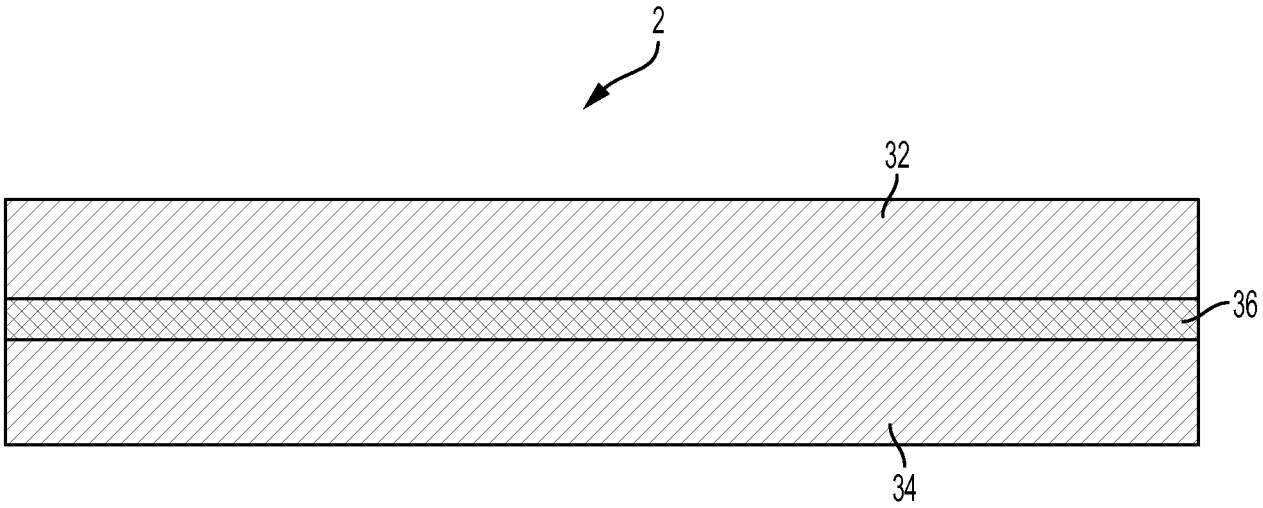
FIG. 2 is a schematic cross-sectional view showing a structure of a roll-up door curtain.

The flexible curtain 2 of the roll-up door system 1 may be made, for example, of rubber material, recycled rubber material, synthetic rubber material, flexible plastic material or fabric material suitable or capable of closing the doorway. FIG. 2 is a schematic cross-sectional view showing a structure of a roll-up door curtain. In an example of realization, the curtain 2 may be a laminated curtain comprising a first layer 32 of flexible recycled rubber material or similar material and a second layer 34 of the same material. Interposed between the first 32 and second 34 layers may be a reinforcing layer 36 of fabric material that may be made, for example, of woven or non-woven fiberglass or nylon fibers. The three (3) layers 32, 34 and 36 are appropriately adhered to each other using a suitable adhesive to form the laminated curtain 2. Suitable adhesives may comprise, without limitation, silicone, styrene, polyurethane, isocyanate, organic adhesives, polymers, acrylics, epoxies, hot melts, and the like.

The curtain 2 may also be a one-layer curtain made of, for example, flexible rubber material, flexible recycled rubber material, flexible synthetic rubber material, flexible plastic material or flexible fabric material.

Figure 3:
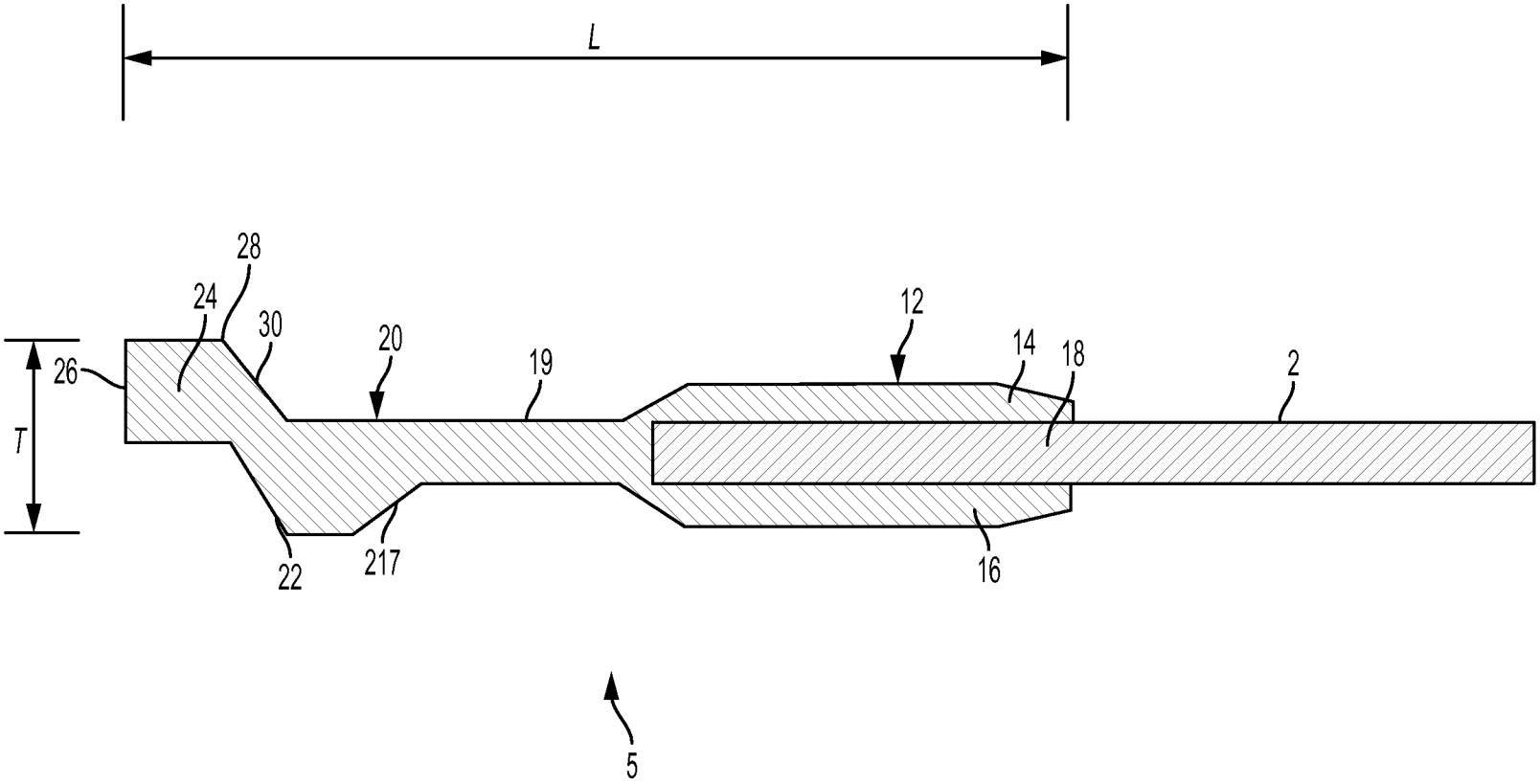
FIG. 3 is a top cross-sectional view of a vertical side strip, part of the roll-up door system of FIG. 1.

FIG. 3 is a top cross-sectional view of a vertical side strip, part of the roll-up door system of FIG. 1. As illustrated in FIG. 3, the vertical side strip 5 is mounted to a side of the curtain 2. The vertical side strip 5 may be made of the same material as the curtain 2, for example flexible rubber material, flexible recycled rubber material, flexible synthetic rubber material, flexible plastic material or flexible fabric material. The vertical side strip 5 may also be laminated in a manner similar to the curtain 2. The vertical side strip 5 may also be extruded or otherwise shaped to form the cross section illustrated in FIG. 3. Without limitation, an overall length "L" of the vertical side strip 5 can vary from 3 to 12 inches and an overall thickness "T" of the vertical side strip 5 can vary from 1¼ in to 3 inches. Of course, dimensions will vary according to specific applications and according to an overall size of the roll-up door.

More specifically, the vertical side strip 5 comprises a proximate longitudinal portion 12, which is U-shaped in cross section, and a distal longitudinal end-section 20 for sliding into the vertical guide 3 of FIG. 1. A link 19 connects the proximate longitudinal portion 12 to the longitudinal end section 20 along their respective lengths.

The proximate longitudinal U-shaped portion 12 defines first and second spaced apart, parallel walls 14 and 16. Sizes, thicknesses and configurations of the vertical side strip 5 may depend on the application and on materials used. As non-limiting examples, the proximate longitudinal portion 12 may be between 2 and 12 inches long, the parallel walls 14 and 16 may have thicknesses between ¼ and ¼ of an inch, the distal longitudinal end-section 20 and the shifted wall section 24 may also have thicknesses between ¼ and ¼ of an inch.

As illustrated in FIG. 3, the vertical side strip 5 is mounted on a corresponding side edge 18 of the curtain 2 by inserting the side edge 18 of the curtain 2 in between the walls 14 and 16 of the longitudinal U-shaped portion 12, and by adhering the opposite longitudinal faces of the side edge 18 to respective inner faces of the walls 14 and 16 of the longitudinal U-shaped portion 12. Adhesives suitable for that purpose may comprise, without limitation, silicone, styrene, polyurethane, isocyanate, organic adhesives polymers, acrylics, epoxies, hot melts, and the like.

The longitudinal end section 20 of the vertical side strip 5 comprises, on one side a first longitudinal rib 22 and, on another side, a shifted wall section 24.

The shifted wall section 24 forms a free edge 26 of the vertical side strip 5. The shifted wall section 24 also defines a second longitudinal rib 28 with a sloping wall 30 on the corresponding side of the vertical side strip 5.

The first longitudinal rib 22 is generally trapezoidal in cross section and is positioned on the side of the vertical side strip 5 opposite the second longitudinal rib 28. Also, the first longitudinal rib 22 is laterally shifted inwardly with respect to the second longitudinal rib 28.

Figure 4:
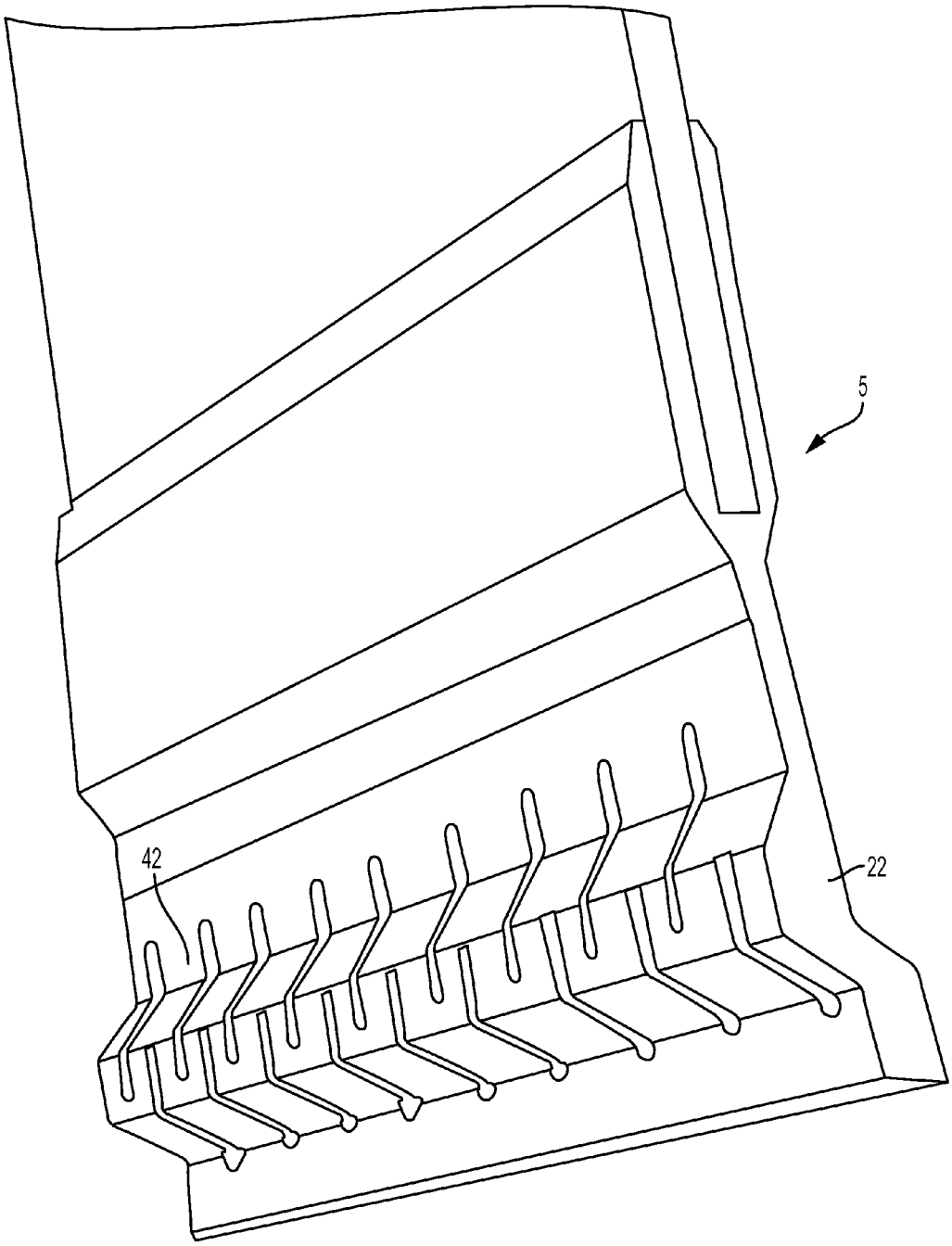
FIG. 4 is a perspective view of the vertical side strip of FIG. 3 as seen from one side.
Figure 5:
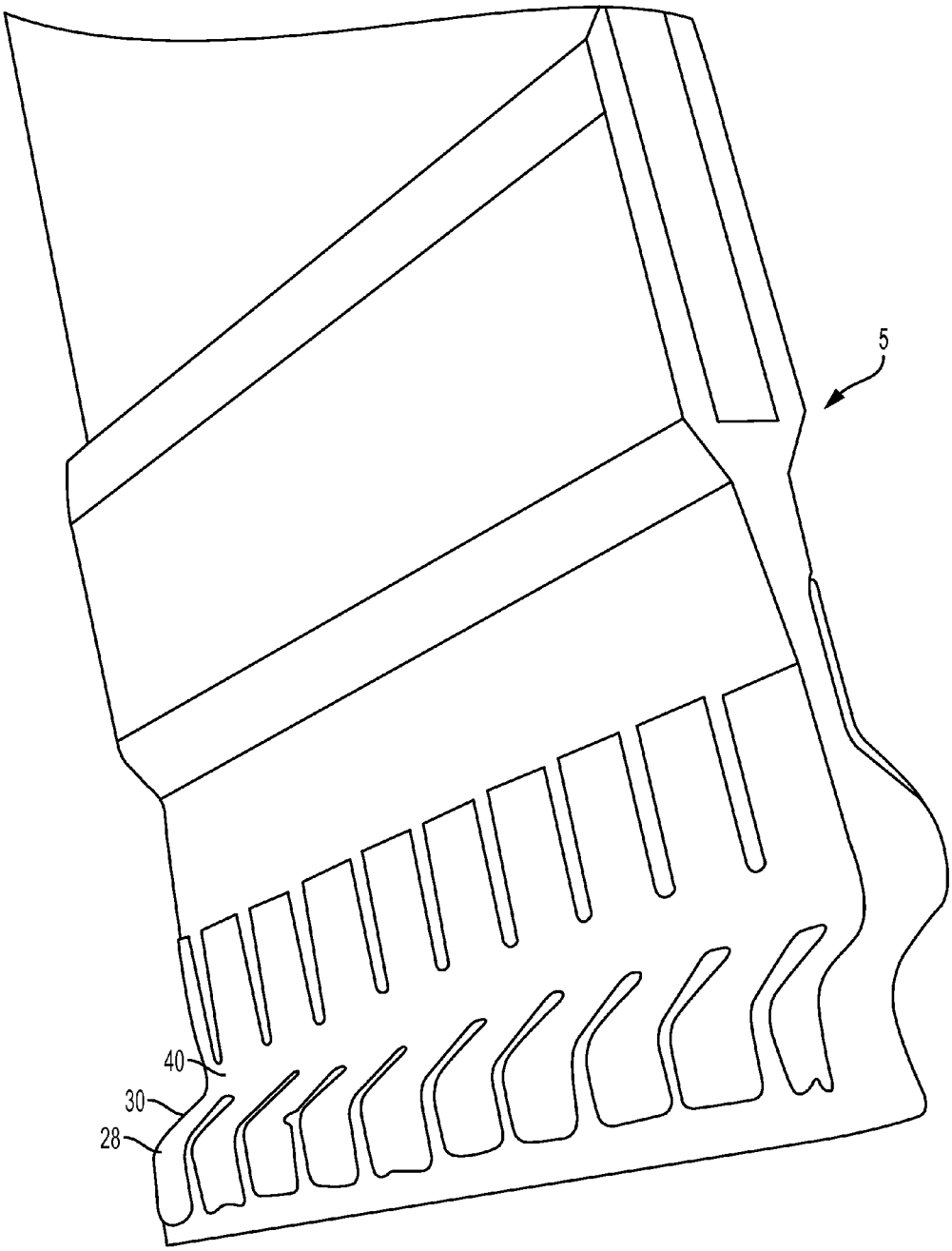
FIG. 5 is a perspective view of the vertical side strip of FIG. 3 as seen from an opposite side.

FIG. 4 is a perspective view of the vertical side strip of FIG. 3 as seen from one side. FIG. 5 is a perspective view of the vertical side strip of FIG. 3 as seen from an opposite side. Referring at once to FIGS. 4 and 5, a layer 40 of plastic slippery and wear-resistant material may be embedded into the surface of the second longitudinal rib 28 and sloping wall 30 to facilitate sliding of the vertical side strip 5 into the vertical guide 3. In the same manner, a layer 42 of plastic slippery and wear-resistant material may be embedded into the surface of the generally trapezoidal first longitudinal rib 22. As a non-limitative example, the plastic slippery and wear-resistant material may comprise Teflon™.

Figure 6:
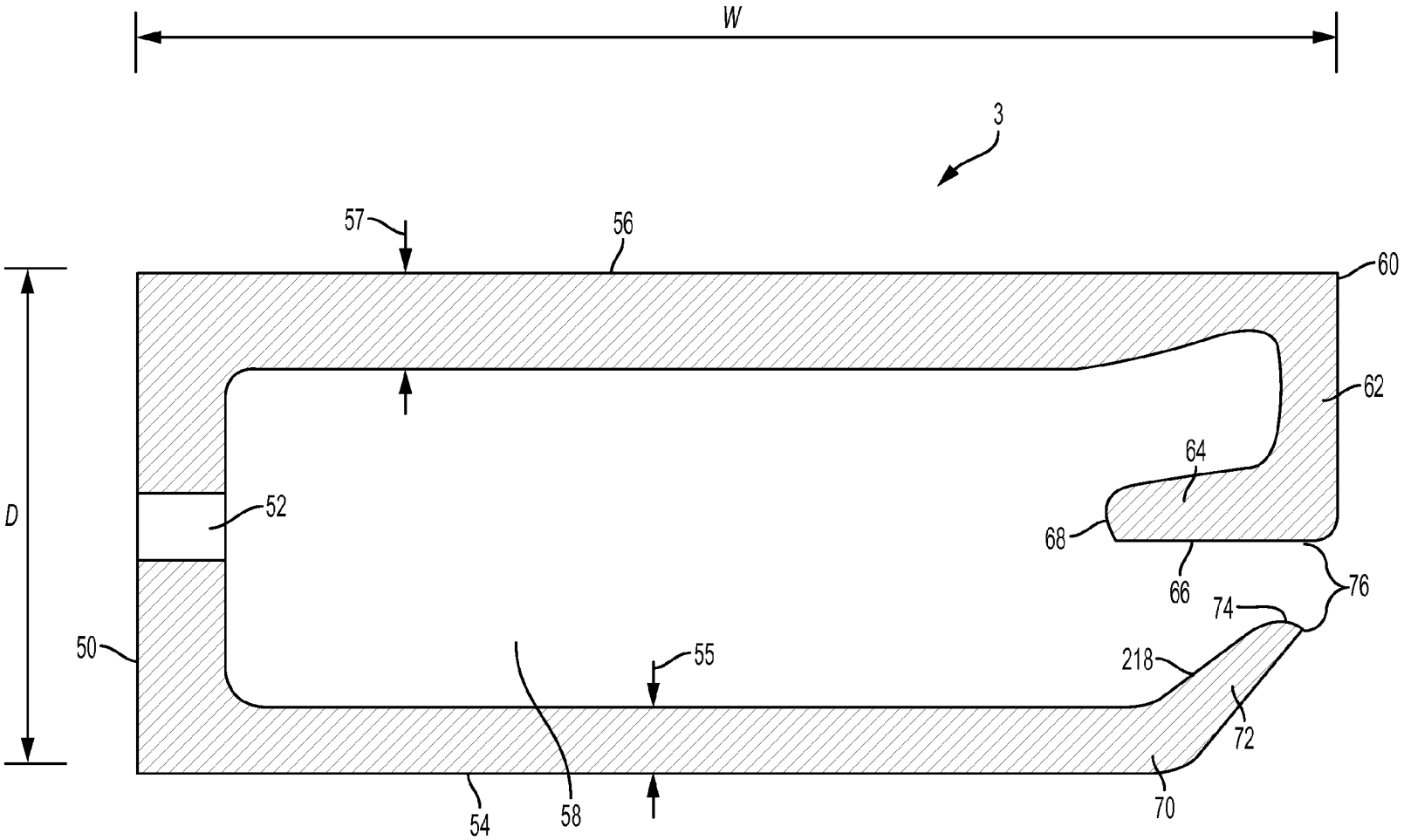
FIG. 6 is a top cross-sectional view of a vertical guide for a roll-up door curtain.

FIG. 6 is a top cross-sectional view of a vertical guide for a roll-up door curtain. According to a first embodiment, the vertical guide 3 is an extruded one-piece vertical guide, which may be made of metal, for example aluminum. The use of any other suitable metal or material can also be contemplated. The vertical guide 3 is deformable, either resiliably or plastically, as will be explained in details herein below.

As illustrated in FIG. 6, the vertical guide 3 comprises a longitudinal rear base wall 50. Holes such as 52, optionally threaded, are provided to allow installation of the vertical guide 3 on the frame 4 of a doorway using bolts (not shown). A pair of longitudinal, spaced apart and parallel or substantially parallel wall sections 54 and 56 extends from the longitudinal base wall 50 to define a cavity 58 between the wall sections 54 and 56. In a particular embodiment, the wall section 54 has a thinner cross-section 55 when compared to a cross-section 57 of the wall section 56. Consequently, while both wall sections 54 and 56 are deformable, the wall section 54 tends to flex with greater amplitude than the wall section 56 when a force is applied to the vertical guide 3.

The vertical guide 3 is sized to accommodate dimensions of the vertical side strip 5. Without limitation, an overall width "W" of the vertical guide 3 can vary from 3 to 24 inches, an overall depth "D" of the vertical guide 3 can vary from 2 to 12 inches, and the cross-sections 55 and 57 can vary from ⅜ to 1 inch. Of course, dimensions will vary according to structural requirements, to specific applications and to an overall size of the roll-up door.

On the front side thereof, the wall portion 56 is bent a first time at 90° (see 60) to form a longitudinal front wall portion 62. The wall portion 56 is bent a second time at 90° to define a wall portion 64 parallel to the wall portions 54 and 56 and defining an inner longitudinal planar face 66, parallel to both the wall portions 54 and 56, and an inner longitudinal edge 68 at an extremity of the inner longitudinal planar face 66.

One the front side thereof, the wall portion 54 is bent inwardly at an obtuse angle (see 70) to form an angular longitudinal wall 72 with a free longitudinal edge 74.

When assembled, the vertical side strip 5 attached to the curtain 2 is movable or slidable longitudinally in the vertical guide 3 as the curtain 2 is raised or lowered during use thereof. Together, the vertical side strip 5 and the vertical guide 3 form a guiding system for a roll-up door having the curtain 2. For this, the longitudinal edge 74 defines with the inner longitudinal planar face 66 a longitudinal slot 76 to receive the link 19 of the vertical side strip 5 between the proximate U-shaped longitudinal portion 12 and the first longitudinal rib 22. Embodiments of the guiding system may comprise two opposed vertical guides 3 on either sides of the curtain 2. In such cases, two symmetrically mounted vertical side strips 5 attached to opposed vertical edges of the curtain 2 move or slide within corresponding vertical guides 3.

Though as shown on FIG. 6, the wall sections 54 and 56 are substantially parallel, other configurations are contemplated. For example, one or both of the wall sections 54 and 56 may be curved. Alternatively, the overall depth "D" may be larger at one end, for example at the end having the threaded holes 52, and narrower at an opposite end, for example at the end having the longitudinal slot 76. An internal shape of the cavity 58 is inconsequential, inasmuch as it is sufficient to accommodate insertion of the distal longitudinal end-section 20 of the vertical side strip 5.

The vertical guide 3 is configured to receive, via the longitudinal slot 76, a longitudinal end section of a roll-up door vertical side strip such as the vertical side strip 5 of FIG. 3. A planar surface of the vertical side strip may then slide on the inner longitudinal planar face 66 of the vertical guide 3. The vertical guide 3 is also configured to internally maintain a longitudinal rib of the longitudinal end section of the roll-up door vertical side strip. The vertical guide 3 will release the vertical side strip by widening of the longitudinal slot 76 upon application on the vertical side strip of a force exceeding a predetermined threshold. As a non-limiting example, the predetermined threshold may ensure release of the vertical side strip upon a wind load of 144 km/hour, or 0.96 kpa.

Figure 7:
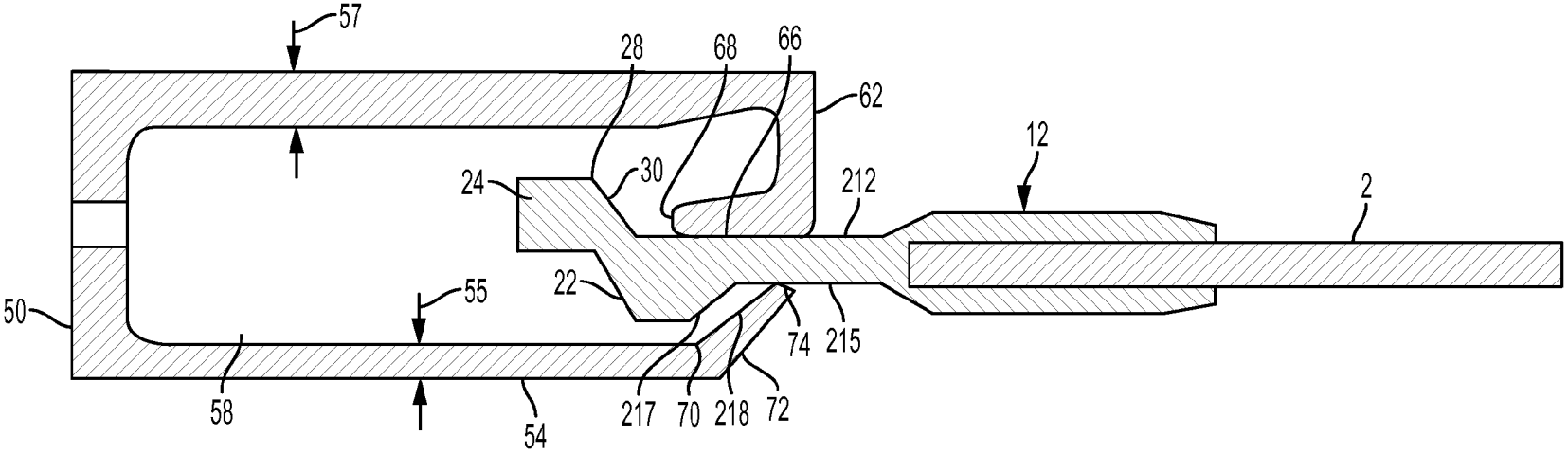
FIG. 7 shows an interaction of the vertical side strip of FIG. 3 with the vertical guide of FIG. 6.

FIG. 7 shows an interaction of the vertical side strip of FIG. 3 with the vertical guide of FIG. 6. Some numeral indices of FIGS. 3 and 6 are not reproduced on FIG. 7 for readability purposes. The vertical side strip 5 defines a first planar surface 212 between the proximate U-shaped longitudinal portion 12 and the shifted wall section 24. The inner longitudinal planar face 66 is a mating surface for the first planar surface 212. The first planar surface 212 can rest or slide on the inner longitudinal planar face 66. The inner longitudinal edge 68 is a mating surface for the sloping wall 30 of the second longitudinal rib 28. The sloping wall 30 can rest or slide on the inner longitudinal edge 68 to maintain the vertical side strip 5 into the cavity 58 of the vertical guide 3. When present, the layer 40 of slippery, wear-resistant plastic material embedded into the surface of the second longitudinal rib 28 and of the sloping wall 30 facilitates sliding of the planar surface 212 onto the inner longitudinal planar face 66 and sliding of the sloping wall 30 on the inner longitudinal edge 68.

In the same manner, the vertical side strip 5 defines a second planar surface 215 opposite the first planar surface 212 between the proximate U-shaped longitudinal portion 12 and the generally trapezoidal first longitudinal rib 22. The second planar surface 215 slides onto the longitudinal edge 74 while a sloping wall 217 of the generally trapezoidal first longitudinal rib 22 slides on the inner surface of the angular longitudinal wall 72 to maintain the vertical side strip 5 into the cavity 58 of the vertical guide 3. The layer 42 of slippery, wear-resistant plastic material embedded into the surface of the generally trapezoidal first longitudinal rib 22 facilitates sliding of the planar surface 215 onto the longitudinal edge 74 and sliding of the sloping wall 217 of the generally trapezoidal first longitudinal rib 22 onto the inner surface of the angular wall 72.

In normal operation, the vertical guide 3 has a cross-section shaped substantially as shown on FIGS. 6 and 7. As the curtain 2 of the roll-up door system 1 is raised or lowered, the vertical side strip 5 slides into the vertical guide 3 with the link 19 of the vertical side strip 5 between the proximate U-shaped longitudinal portion 12 and the first longitudinal rib 22 sliding in the longitudinal slot 76. More specifically, the first planar surface 212 slides on the inner longitudinal planar face 66 with the sloping wall 30 of the shifted wall section 24 sliding on the inner longitudinal edge 68 to retain the vertical side strip 5 into the cavity 58 of the vertical guide 3. Also, the second planar surface 215 opposite the first planar surface 212 slides onto the longitudinal edge 74 while the sloping wall 217 of the generally trapezoidal first longitudinal rib 22 mates with an inner surface 218 of the angular longitudinal wall 72, sliding or resting thereon to maintain the vertical side strip 5 into the cavity 58 of the vertical guide 3.

However, when a wind load or impact causing a load exceeding a predetermined threshold is applied upon the curtain 2, this load being transmitted to the vertical side strip 5, such wind load or impact will cause deformation of the vertical guide 3, in which the wall portions 54 and 56 separate from each other at the front of the vertical guide 3 to thereby spread apart the longitudinal edge 74 and the inner longitudinal planar face 66, thereby widening the longitudinal slot 76. Because the cross-section 55 of the wall portion 54 is thinner than the cross-section 57 of the wall portion 56, the wall portion 54 tends to undergo a greater deformation than the wall portion 56 when a force is applied to the vertical guide 3. Widening of the longitudinal slot 76 in turn allows the generally trapezoidal first longitudinal rib 22, at first, and then the shifted wall section 24, to pass through the longitudinal slot 76 and release the vertical side strip 5 from the vertical guide 3 with little, if any, damage to the curtain 2 or the vertical guide 3. Notably, the obtuse angle 70 allows the sloping wall 217 to slide on the angular longitudinal wall 72 with relative ease. Of course, resilient material, for example aluminum, will enable such deformation of the vertical guides 3. The deformation may be substantially elastic so that the vertical guide 3 returns to its original shape after deformation. The predetermined threshold for allowing release of the vertical side strip 5 under excessive wind load or under impact may be determined by those of ordinary skill in the art by proper selection of material for making the vertical guide 3 as well as by proper selection of the geometry, thickness, and size configurations of the various elements of the vertical guide 3. In particular, thicknesses of the cross-sections 55 and 57 may be selected according to a desired predetermined threshold.

As an economical variant, the vertical guide 3 may be manufactured using a material that may be plastically deformable. While such vertical guide 3 may need to be repaired or replaced as a result of an event in which the vertical side strip 5 has been pulled out of the vertical guide 3, overall damages should still be limited as the curtain 2, and the doorway frame 4 may remain essentially unaffected.

Figure 8:
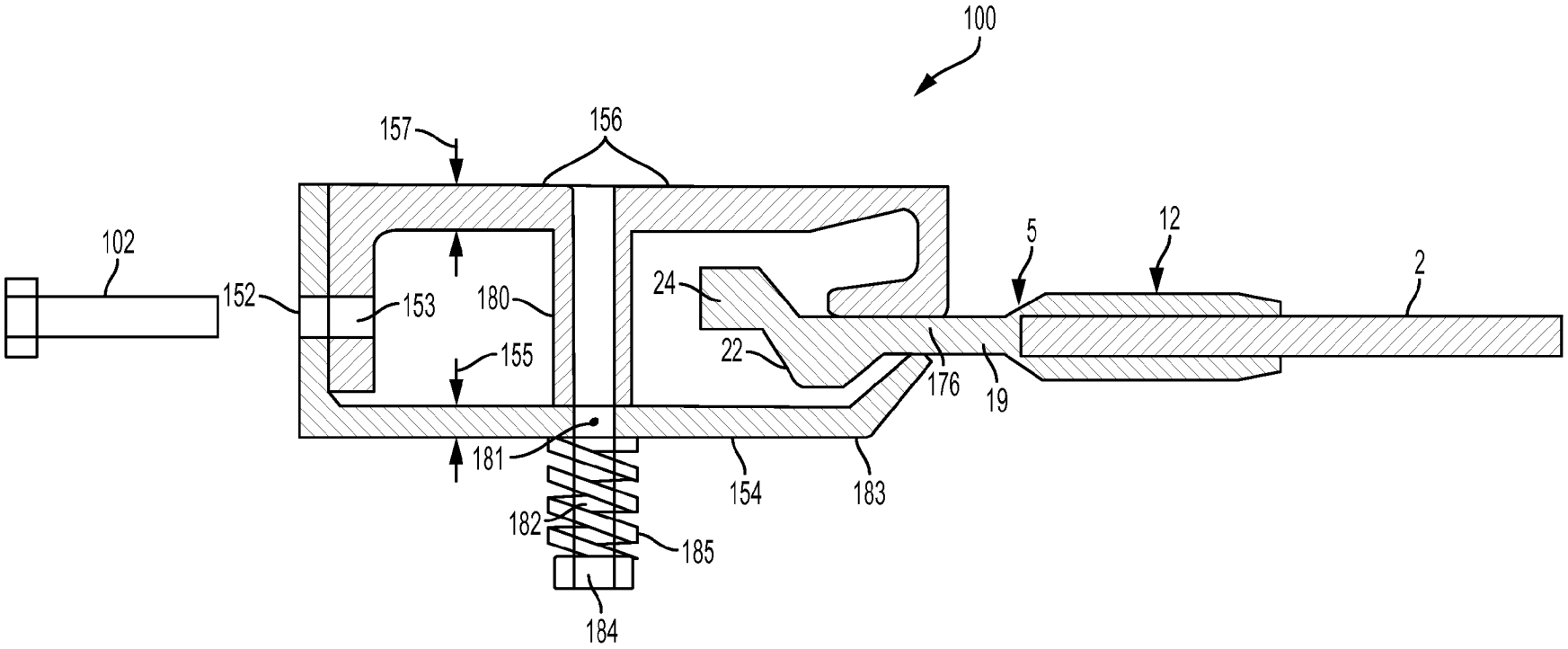
FIG. 8 shows an interaction of the vertical side strip of FIG. 3 with a first variant of the vertical guide.

FIG. 8 shows an interaction of the vertical side strip of FIG. 3 with a first variant of the vertical guide. A vertical guide 100 is adapted to operate with the vertical side strip 5 as described hereinabove. The vertical guide 100 comprises a first vertical guide portion 154 and a second vertical guide portion 156 having respective series of threaded holes 152 and 153 for attachment to a doorway frame 4 using bolts such as 102. In a particular embodiment, the first vertical guide portion 154 has a thinner cross-section 155 when compared to a cross-section 157 of the second vertical guide portion 156.

The first vertical guide portion 154 is biased against a series of cylindrical, inner projections 180 of the second vertical guide portion 156 by a biasing element, for example a series of springs 185. Each cylindrical projection 180 is threaded on its internal surface. The first vertical guide portion 154 comprises a non-threaded hole 181 in alignment with the cylindrical projection 180. Each spring 185 is mounted onto a bolt 182 between an outer surface 183 of the first vertical guide portion 154 and a head 184 of the bolt 182. The bolt 182 is threaded into the internally threaded cylindrical projection 180 through the hole 181.

In normal operation, the springs 185 maintains the first vertical guide portion 154 in a rest position against the projection 180 of the second vertical guide portion 156, as shown on FIG. 8. While in the rest position, the first vertical guide portion 154 forms, with the second vertical guide portion 156, a longitudinal slot 176 for receiving the link 19 of the vertical side strip 5 between the proximate U-shaped longitudinal portion 12 and the first longitudinal rib 22. It can thus be appreciated that, in normal operation, the vertical guide 100 operates in an equivalent manner to the vertical guide 3 of earlier Figures.

Under excessive wind load or impact conditions, the vertical guide 100 is deformed by moving the first vertical guide portion 154 away from the second vertical guide portion 156, compressing the springs 185, thereby widening the longitudinal slot 176 to allow the generally trapezoidal first longitudinal rib 22 first, and then the shifted wall section 24, to pass through the longitudinal slot 176 and releasing the vertical side strip 5 from the vertical guide 100. In the embodiment of FIG. 8, the predetermined threshold for releasing the vertical side strip 5 under excessive wind load or under impact may be adjusted by proper selection of material for making the vertical guide 100, by proper selection of the geometry, thickness and size configurations of the various elements of the vertical guide 100, and by a number and a level of resilience of the springs 185.

Figure 9A:
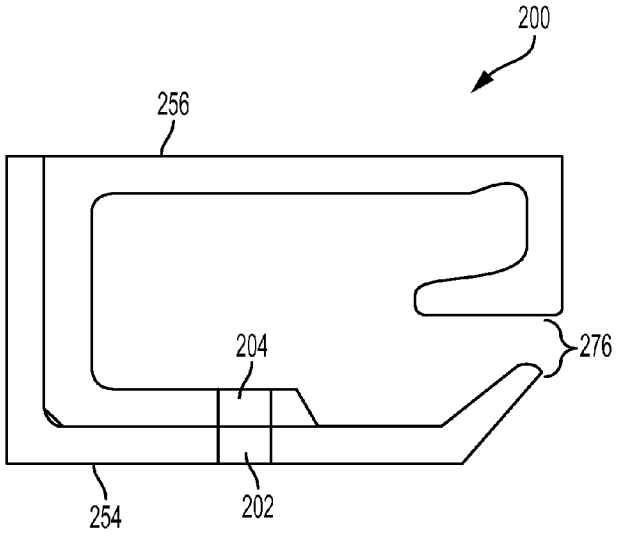
FIG. 9*a* is a top cross-sectional view of a second variant of the vertical guide.
Figure 9B:
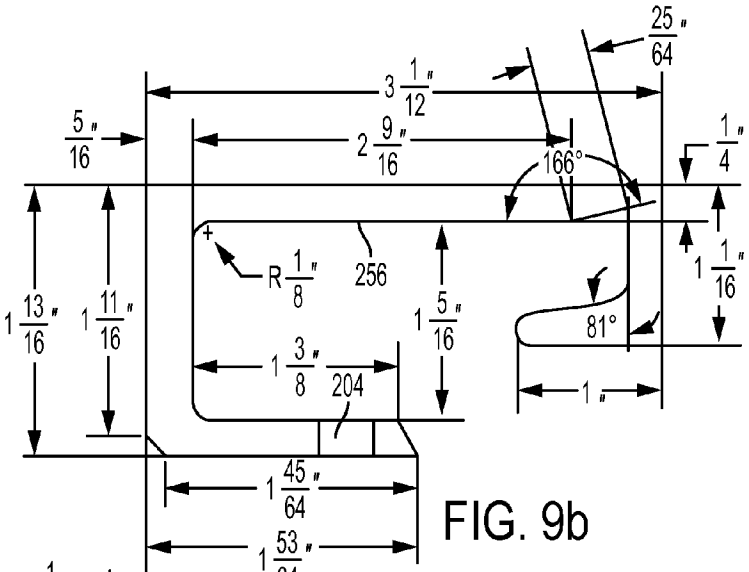
FIG. 9*b* is a top cross-sectional view of one portion of the vertical guide of FIG. 9*a*.
Figure 9C:
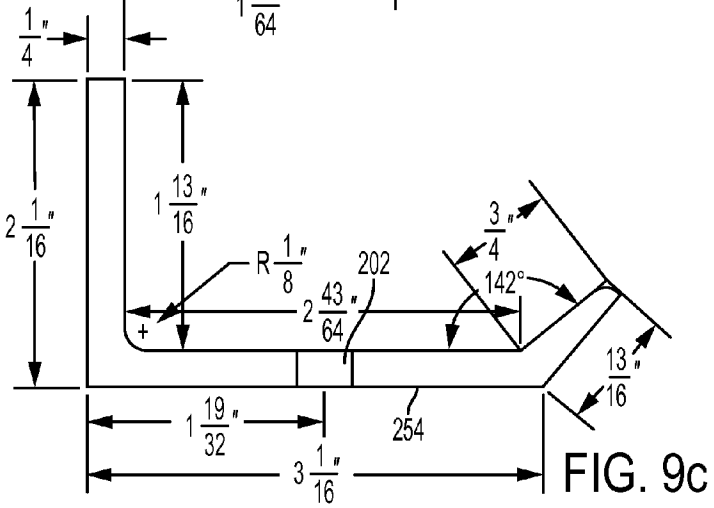
FIG. 9*c* is a top cross-sectional view of another portion of the vertical guide of FIG. 9*a*.

FIG. 9*a* is a top cross-sectional view of a second variant of the vertical guide. FIG. 9*b* is a top cross-sectional view of one portion of the vertical guide of FIG. 9*a*. FIG. 9*c* is a top cross-sectional view of another portion of the vertical guide of FIG. 9*a*. Referring at once to FIGS. 9*a*, 9*b* and 9*c*, a vertical guide 200 is adapted to operate with the vertical side strip 5 as described hereinabove. The vertical guide 200 comprises a first vertical guide portion 254 and a second vertical guide portion 256, respectively having series of threaded holes for attachment to a doorway frame 4 using bolts. These threaded holes are not shown in the cross-sectional view of FIGS. 9*a*, 9*b* and 9*c*, but are located along a height of the vertical guide 200, in the same or similar manner as threaded holes 142, 153 and bolts 102 of FIG. 8. The first and second vertical guide portions 254 and 256 can be separably mounted on the doorway frame 4.

Holes 202 and 204 are provided on the first and second vertical guide portions 254 and 256, respectively, allowing assembly of these two portions using bolts and nuts (not shown), or similar attachments. A function and operation of the vertical guide 200 is similar to that of the vertical guide 3 of FIG. 6. However, a longitudinal slot 276 defined between the first and second vertical guide portions 254 and 256 can be made to vary in width upon installation of the vertical guide 200 on the doorway frame 4. For example, the longitudinal slot 276 can be made tighter at the bottom of the doorway frame 4, becoming slightly wider towards the top of the doorway frame 4, in order to accommodate for generally higher load pressure present at the bottom of a roll-up door.

On FIGS. 9*b* and 9*c*, all dimensions are in inches, except for angles which are in degrees, and are provided as a non-limiting example embodiment.

Though embodiments of the door, deformable guide and guiding system have been presented hereinabove in the context of roll-up doors, it should be understood that the present disclosure equally applies in the context of rollable doors operating in a vertical plane but mounted on horizontal guides. As a result, the present disclosure includes components of a rollable door having a vertical curtain that may be rolled sideways between an upper horizontal guide and a lower horizontal guide. The present disclosure further applies to rollable doors operating in a horizontal plane, having a horizontal curtain rollable between two horizontal guides generally positioned at a same height. Such doors may for example act as opening and closing covers for food and grain storage and for fertilizer hoppers.

Those of ordinary skill in the art will realize that the description of the door, deformable guide and guiding system for rollable doors are illustrative only and are not intended to be in any way limiting. Other embodiments will readily suggest themselves to such persons with ordinary skill in the art having the benefit of the present disclosure. Furthermore, the disclosed door, deformable guide and guiding system may be customized to offer valuable solutions to existing needs and problems of limiting damages to buildings under excessive load situations.

In the interest of clarity, not all of the routine features of the implementations of the door, deformable guide and guiding system are shown and described. It will, of course, be appreciated that in the development of any such actual implementation of the door, deformable guide and guiding system, numerous implementation-specific decisions may need to be made in order to achieve the developer's specific goals, such as compliance with application-, system-, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of door systems having the benefit of the present disclosure.

Although the present disclosure has been described hereinabove by way of non-restrictive, illustrative embodiments thereof, these embodiments may be modified at will within the scope of the appended claims without departing from the spirit and nature of the present disclosure.

What is claimed is:

1. A guiding system for a rollable door, comprising:

a deformable guide having two wall portions, a first one of the wall portions comprising an angular longitudinal wall leading to and defining a longitudinal edge, a second one of the wall portions defining an inner longitudinal planar face terminating at an inner longitudinal edge, the inner longitudinal planar face and the longitudinal edge defining a longitudinal slot; and a side strip for attachment to a curtain of the rollable door, the side strip having a longitudinal end section insertable into the guide via the longitudinal slot, the side strip having a planar surface for mating with the inner longitudinal planar face, the longitudinal end section comprising a pair of longitudinal ribs for maintaining the side strip within the guide, the pair of longitudinal ribs including, on one face of the side strip, a first longitudinal rib having a generally trapezoidal shape adapted for resting on the angular longitudinal wall of the first one of the wall portions and including, on an opposite face of the side strip, a second longitudinal rib having a shifted wall section adapted for resting on the inner longitudinal edge of the second one of the wall portions;

wherein the guide is configured to release the side strip by widening of the longitudinal slot upon application on the side strip of a force exceeding a predetermined threshold.

2. The guiding system of claim 1, comprising a surface layer of plastic slippery and wear-resistant material on the planar surface of the side strip.

3. The guiding system of claim 1, wherein the rollable door is a roll-up door, the guide is a vertical guide and the side strip is a vertical side strip.

4. A door, comprising:

a flexible door curtain;

a guiding system for attachment to a door frame, the guiding system comprising:

a deformable guide having two wall portions, a first one of the wall portions comprising an angular longitudinal wall leading to and defining a longitudinal edge, a second one of the wall portions defining an inner longitudinal planar face terminating at an inner longitudinal edge, the inner longitudinal planar face and the longitudinal edge defining a longitudinal slot; and a side strip for attachment to the door curtain, the side strip having a longitudinal end section insertable into the guide via the longitudinal slot, the side strip having a planar surface for mating with the inner longitudinal planar face, the longitudinal end section comprising a pair of longitudinal ribs for maintaining the side strip within the guide, the pair of longitudinal ribs including, on one face of the side strip, a first longitudinal rib having a generally trapezoidal shape adapted for resting on the angular longitudinal wall of the first one of the wall portions and including, on an opposite face of the side strip, a second longitudinal rib having a shifted wall section adapted for resting on the inner longitudinal edge of the second one of the wall portions;

wherein the guide is configured to release the side strip by widening of the longitudinal slot upon application on the door curtain of a force exceeding a predetermined threshold.

5. The door of claim 4, comprising a roller for rolling the door curtain.

6. The door of claim 4, comprising:

two deformable guides for attachment to both sides of the door frame; and two side strips for attachment to both sides of the door curtain.

7. The door of claim 4, wherein the door is a roll-up door, the guide is a vertical guide and the side strip is a vertical side strip.

* * * * *